US007382209B2

(12) United States Patent
Watanabe

(10) Patent No.: US 7,382,209 B2
(45) Date of Patent: Jun. 3, 2008

(54) NON-RECIPROCAL CIRCUIT DEVICE

(75) Inventor: Yoshitsugu Watanabe, Tokyo (JP)

(73) Assignee: TDK Corporation, Tokyo (JP)

( * ) Notice: Subject to any disclaimer, the term of this patent is extended or adjusted under 35 U.S.C. 154(b) by 173 days.

(21) Appl. No.: 11/237,847

(22) Filed: Sep. 29, 2005

(65) Prior Publication Data

US 2006/0226925 A1 Oct. 12, 2006

(30) Foreign Application Priority Data

Sep. 29, 2004 (JP) ..... 2004-285069

(51) Int. Cl.
*H01P 1/38* (2006.01)

(52) U.S. Cl. ..... 333/1.1; 333/24.2

(58) Field of Classification Search ..... 333/1.1, 333/24.2

See application file for complete search history.

(56) References Cited

U.S. PATENT DOCUMENTS

| | | | | |
|---|---|---|---|---|
| 4,276,522 | A * | 6/1981 | Coerver | 333/1.1 |
| 6,011,449 | A | 1/2000 | Jussaume et al. | |
| 6,337,607 | B1 | 1/2002 | Genfan | |
| 6,955,553 | B2 | 10/2005 | Watanabe | |

FOREIGN PATENT DOCUMENTS

| | | |
|---|---|---|
| JP | 2-17413 | 2/1990 |
| JP | 6-52844 | 7/1994 |
| JP | 9-222371 | 8/1997 |
| JP | 10-294606 | 11/1998 |
| JP | 2002-111323 | 4/2002 |
| JP | 3399099 | 2/2003 |
| JP | 2003-124711 | 4/2003 |

* cited by examiner

*Primary Examiner*—Stephen E Jones
(74) *Attorney, Agent, or Firm*—Oblon, Spivak, McClelland, Maier & Neustadt, P.C.

(57) ABSTRACT

There is provided a non-reciprocal circuit device which is suitable for a reduction in height, an increase in a mechanical securing strength and a reduction in a number of components, and has a improvement in the yield of assembly, a sufficiently reduction in the man-hour and cost for assembly.

A gyromagnetic component assembly 10 is accommodated in a holder 30. A support member 40 has a holder insertion hole 44 which is opened on at least one surface 411. A holder 30 has a bottom outer surface 32 inserted in the holder insertion hole 44.

19 Claims, 8 Drawing Sheets

NON-RECIPROCAL CIRCUIT DEVICE

TECHNICAL FIELD

The present invention relates to a non-reciprocal circuit device such as an isolator, circulator, etc.

BACKGROUND OF THE INVENTION

A non-reciprocal circuit device such as an isolator or a circulator is used in, e.g., a mobile communication device such as a mobile phone or a wireless device, or a communication device utilized in a base station of such a mobile communication device.

This type of non-reciprocal circuit device is configured to accommodate an assembly including a permanent magnet, a magnetic pole plate, and a gyromagnetic component in a magnetic metal holder which functions as a yoke.

Meanwhile, in recent years, in this type of non-reciprocal circuit device, a reduction in height is an important technical problem in order to cope with a demand for a reduction in size and weight of a mobile communication device.

Further, in this type of non-reciprocal element, there arises a concern over reliability when a stress, reheating or the like is applied to a terminal substrate by reworking and others, which results in a problem of an apprehension about recycling of a product and a problem of generation of a yield loss. In order to solve these problems, it is important for the non-reciprocal circuit device to have a configuration with a high mechanical securing strength.

Furthermore, in terms of cost reduction, important points are a reduction in the number of components, a improvement in the yield of assembly, a decrease in the number of assembling steps and a low assembly cost.

Moreover, it is preferable for the non-reciprocal circuit device to include a configuration in which a layout can be readily changed when any other additional circuit must be installed by any method. In particular, in case of developing a variation having a receptacle configuration, it is important to avoid an increase in a manufacturing cost.

Various configurations about this type of non-reciprocal circuit device have been conventionally proposed. As concrete typical examples, Patent References 1 to 4 can be cited.

However, it cannot be said that Patent References 1 to 4 can sufficiently solve the above-described problems.

Patent Reference 1: JP 2003-124,711A

Patent Reference 2: JP H10-294,606A

Patent Reference 3: JP 3,399,099B2

Patent Reference 4: U.S. Pat. No. 6,337,607B1

SUMMARY OF THE INVENTION

It is an object of the present invention to provide a non-reciprocal circuit device which can achieve a reduction in height of an electronic component.

It is another object of the present invention to provide a non-reciprocal circuit device having a high mechanical securing strength.

It is still another object of the present invention to provide a non-reciprocal circuit device which has a reduction in the number of components, an improvement in the yield of assembly, and a reduction in the man-hour and cost for assembly.

It is yet another object of the present invention to provide a non-reciprocal circuit device which can readily develop a receptacle variation.

In order to achieve these objects, a non-reciprocal circuit device according to the present invention includes an assembly having a gyromagnetic component, a holder and a support member. The assembly is accommodated in the holder. The support member has a holder insertion hole which is opened on at least one surface. The holder has a bottom outer surface inserted in the holder insertion hole.

As described above, the support member has the holder insertion hole which is opened on at least one surface, and the bottom outer surface of the holder is inserted in the holder insertion hole. According to this configuration, it is possible to realize a non-reciprocal circuit device having a high mechanical securing strength.

Furthermore, a position of a bottom portion of the holder is lowered by an amount corresponding to an insertion depth in the holder insertion hole, which can contribute to a reduction in height. Additionally, a height can be reduced without decreasing a capacity of an inner space of the holder.

Further, since a configuration in which the holder is inserted into the holder insertion hole is adopted, a known technique such as a fitting structure can be applied as an insertion conformation. Therefore, it is possible to provide a non-reciprocal circuit device having a reduction in the number of components, an improvement in the yield of assembly, and a reduction in the man-hour and cost for assembly.

Furthermore, a part of the support member which extends toward the outside of the holder insertion hole can be utilized to add a terminal, a monitor circuit, an isolator terminating resistor or the like, and a terminal configuration for surface mounting or development of a receptacle variation can be carried out.

In the fitting configuration of the holder and the support member mentioned above, since the assembly is accommodated in the holder, a position of the bottom outer surface of the holder is lowered by an amount corresponding to an insertion depth in the holder insertion hole. Therefore, according to the non-reciprocal circuit device of the present invention, since a height can be reduced without decreasing a capacity of an inner space of the holder, a reduction in the height can be maintained even when the assembly is accommodated in the holder.

In a preferred embodiment according to the present invention, the holder includes a coupling protrusion piece, and the holder insertion hole has a concave step portion at a hole edge. The coupling protrusion piece is fitted in the concave step portion. According to this configuration, it is possible to provide a non-reciprocal circuit device having a higher mechanical securing strength of the holder and the support member.

As another preferred embodiment, the holder insertion hole can be configured to pierce from one surface to the other surface of the support member. In this case, a height of the non-reciprocal circuit device can be reduced by an amount corresponding to a thickness of the support member at a maximum.

As still another preferred embodiment, based on a configuration in which the bottom outer surface of the holder and the other surface of the support member have parts which are substantially the same planes, a bottom surface of the non-reciprocal circuit device can be flattened. Therefore, the non-reciprocal circuit device according to the present invention can be readily subjected to plan processing and stably surface-mounted with respect to any other electronic component constituting a mobile communication device, a print pattern and others.

As described above, according to the present invention, the following effects can be obtained.

(a) A non-reciprocal circuit device which can achieve a reduction in the height of an electronic circuit can be provided.

(b) A non-reciprocal circuit device having a high mechanical securing strength can be provided.

(c) It is possible to provide a non-reciprocal circuit device having a reduction in the number of components, an improvement in the yield of assembly, and a reduction in the man-hour and cost for assembly.

(d) It is possible to provide a non-reciprocal circuit device capable of readily developing a receptacle variation.

Other objects, configurations and advantages of the present invention will now be described in detail with reference to the accompanying drawings. However, the accompanying drawings show just examples.

DESCRIPTION OF THE PREFERRED EMBODIMENTS

Figure 1:
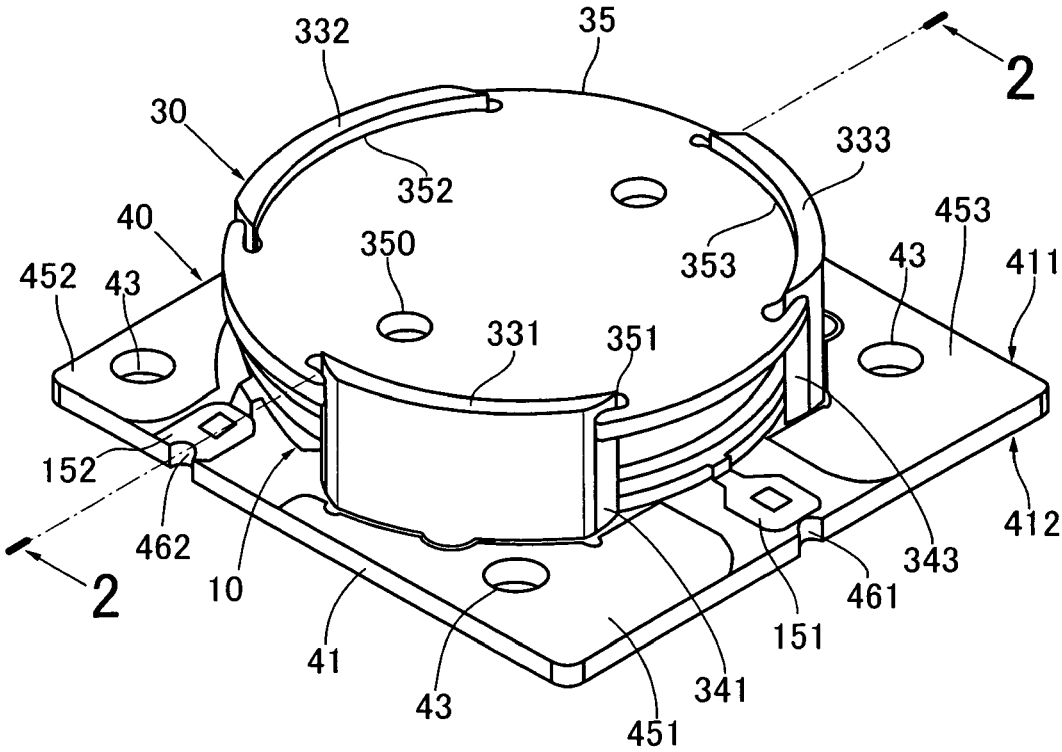
FIG. 1 is a perspective view of a non-reciprocal circuit device according to an embodiment of the present invention.
Figure 2:
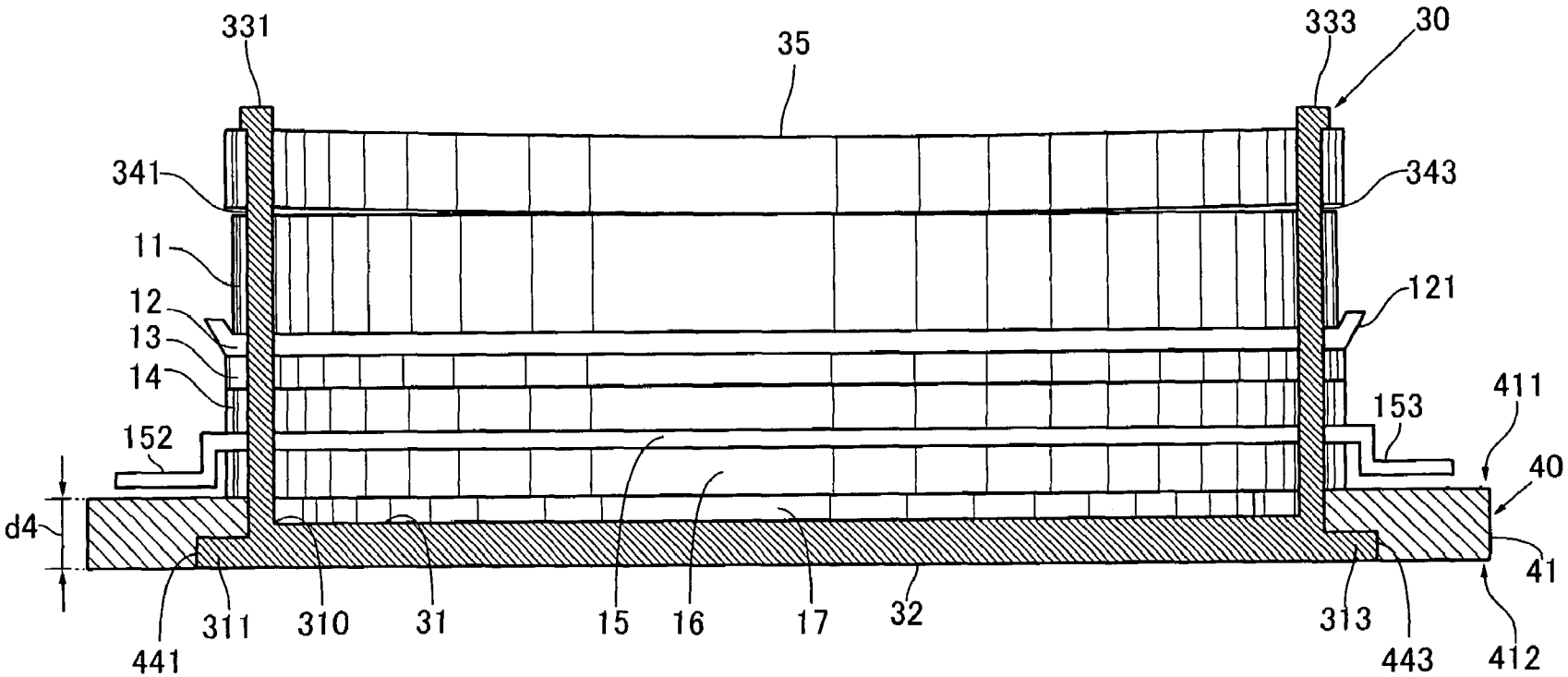
FIG. 2 is an end sectional view taken along a line 2-2 in FIG. 1.
Figure 3:
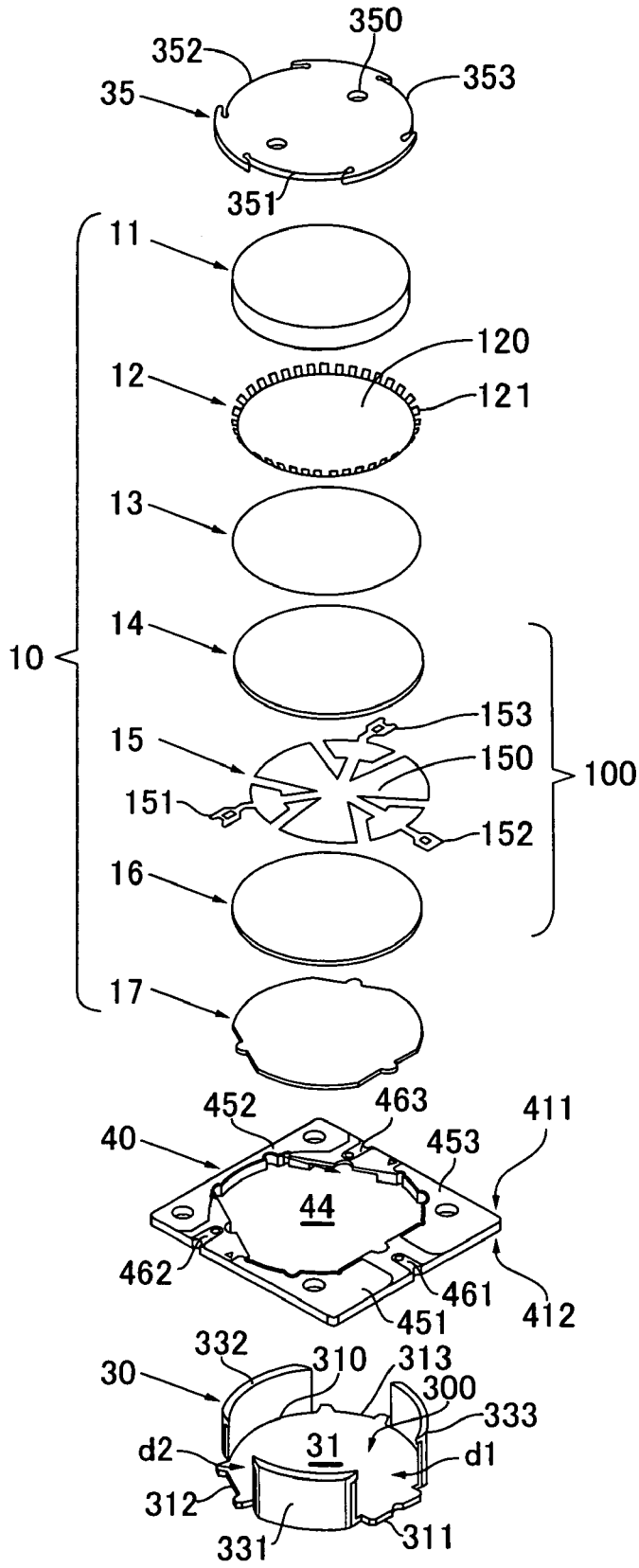
FIG. 3 is a perspective view showing a disassembled configuration of the non-reciprocal circuit device depicted in FIGS. 1 and 2.

Embodiments depicted in FIGS. 1 to 3 show an example in which a circulator is configured.

Referring to FIGS. 1 to 3, a non-reciprocal circuit device according to the present invention includes a gyromagnetic component assembly 10, a holder 30 and a support member 40. The gyromagnetic component assembly 10 has a permanent magnet 11, a grounding shield 12, an upper magnetic pole plate 13, a gyromagnetic component 100, and a lower magnetic pole plate 17, and these members are superimposed in the mentioned order.

Each constituent member of the gyromagnetic component assembly 10 will now be described. First, the grounding shield 12 is formed of a conductor plate punched out from a copper plate having a thickness of approximately 0.1 to 0.2 mm, and used for intensification and stabilization of an earth electrode. The grounding shield 12 shown in FIGS. 1 to 3 has a discoid shape in which a base body portion 120 has a diameter of several-ten mm, is set to a dimension substantially the same as a lower surface of the permanent magnet 11, and includes a plurality of convex pieces 121 along an outer rim thereof.

The permanent magnet 11 is set in a plane of the base body portion 120 of the grounding shield 12, and held by the convex pieces 121. It is to be noted that, when the permanent magnet 11 is formed of a magnetic material having electroconductive properties, e.g., a metal magnet, the grounding shield 12 can be eliminated in the gyromagnetic component assembly 10.

The upper magnetic pole plate 13 is constituted of a conductor plate punched out from an iron plate having a thickness of approximately 0.1 to 0.3 mm, and formed into a discoid shape having a diameter of several-ten mm. The lower magnetic pole plate 17 is constituted of a conductor plate punched out from an iron plate having a thickness of 0.3 to 1.0 mm, and formed into a discoid shape having a diameter of several-ten mm. The upper magnetic pole plate 13 and the lower magnetic pole plate 17 are used for homogenization and stabilization of a direct-current magnetic field.

The gyromagnetic component 100 includes an upper ferrite 14, a central conductor 15 and a lower ferrite 16, and these members are superimposed in the mentioned order.

Moreover, a soft magnetic material such as yttrium/iron/garnet (YIG) is preferable for the upper ferrite 14, and the upper ferrite 14 is formed into a discoid shape having a diameter of several-ten mm and a thickness of approximately 1 mm. A soft magnetic material such as yttrium/iron/garnet (YIG) is preferable for the lower ferrite 16, and the lower ferrite 16 is formed into a discoid shape having a diameter of several-ten mm and a thickness of approximately 1 mm.

The central conductor 15 is preferably a conductor plate obtained by processing a copper plate having a thickness of approximately 0.3 to 1.0 mm, and has a base body portion 150 and first to third terminals 151 to 153 protruding on an outer periphery of the base body portion 150. The base body portion 150 is formed into a circular shape having a diameter of several-ten mm, and has a size which is substantially the same as the plate plane of each of the upper ferrite 14 and the lower ferrite 16.

The first to third terminals 151 to 153 protrude from the base body portion 150, and each of these terminals is bent in the vicinity of an upper surface edge of the lower ferrite 16. The central conductor 15 is held between the upper ferrite 14 and the lower ferrite 16.

The holder 30 is a substantially cylindrical body with a bottom which has a height dimension of approximately several-ten mm, and is preferably formed of a magnetic metal material such as iron. Referring to FIGS. 1 to 3, the holder 30 includes a bottom inner surface 31, a bottom outer surface 32, first to third side wall portions 331 to 333 and a lid member 35.

The first to third side wall portions 331 to 333 respectively rise from an inner rim 310 of the bottom inner surface 31, and are provided at first to third intervals d1 to d3. Each of the first to third intervals d1 to d3 is provided with an opening edge on the same plane side as the bottom inner surface 31.

Furthermore, a first concave groove 341 linearly extending along a height direction is provided at both ends of the first side wall portion 331 in a width direction, and a convex retainer is provided at an end portion of the same in a height direction. Likewise, a second concave groove 342 linearly extending along the height direction is provided at both ends of the second side wall portion 332 in the width direction, and a convex retainer is provided at an end portion of the same in the height direction. A third concave groove 343 linearly extending along the height direction is provided at both ends of the third side wall portion 333 in the width direction, and a convex retainer is provided at an end portion of the same in the height direction.

The gyromagnetic component assembly 10 is accommodated in the holder 30. In more detail, the holder 30 has an inner space 300 partitioned by the bottom inner surface 31 and the first to third side wall portions 331 to 333. In the holder 30, the gyromagnetic component assembly 10 is accommodated in the inner space 300, and an upper end of the inner space 300 is closed by the lid member 35.

The holder 30 includes first to third coupling projection pieces 311 to 313. The first coupling projection piece 311 is provided so as to protrude from the inner rim 310 of the bottom inner surface 31 in a radial direction in the first interval d1. Likewise, the second coupling projection piece 312 is provided so as to protrude from the inner rim 310 in the radial direction in the second interval d2, and the third coupling projection piece 313 is provided so as to protrude from the inner rim 310 of the bottom inner surface 31 in the radial direction in the third interval d3. The gyromagnetic component assembly 10 is positioned by the first to third side wall portions 331 to 333.

The lid member 35 is a discoid body formed of a magnetic material such as iron, and provided with first to third coupling grooves 351 to 353 on an outer rim thereof. The lid member 35 is used as a yoke. The lid member 35 according to the illustrated embodiment entirely has a concave shape before fitting, and applies a load to the gyromagnetic component assembly 10 provided in the inner space 300 when assembled to the holder 30. Giving a detailed description, in the lid member 35, both ends of each of the first to third coupling grooves 351 to 353 in the width direction are fitted in each of the first to third concave grooves 341 to 343. In this convexo-concave coupling configuration, when the both ends of each of the first to third coupling grooves 351 to 353 in the width direction are coupled with the first to third concave grooves 341 to 343, generation of a reactive force of restoration of a deflection in the lid member 35 applies a load to the gyromagnetic component assembly 10 in a direction of the bottom inner surface 31 of the holder 30.

The support member 40 is configured to include a base body portion 41, through holes 43, a holder insertion hole 44, and first to third ground electrodes 451 to 453.

The base body portion 41 is preferably formed of an insulating resin material. In the drawing, the base body portion 41 is a tabular body having a substantially square shape, and configured to have a thickness of approximately 1.0 to 2.0 mm. The through hole 43 has a circular hole shape having a diameter of several-ten mm, pierces from one surface (a front side) 411 of the base body portion to the other surface (a back side) 412 of the same.

The first to third ground electrodes 451 to 453 are provided around the first to third side wall portions 331 to 333 on one surface 411 and the other surface 412 of the base body portion 41.

The support member 40 has the holder insertion hole 44 which is opened on at least one surface 411. The illustrated holder insertion hole 44 pierces from one surface 411 to the other surface 412 of the support member 40. Moreover, the holder insertion hole 44 has first to third concave step portions 441 to 443 on an inner rim 440 on the other surface 412 side of the base body portion.

Figure 4:
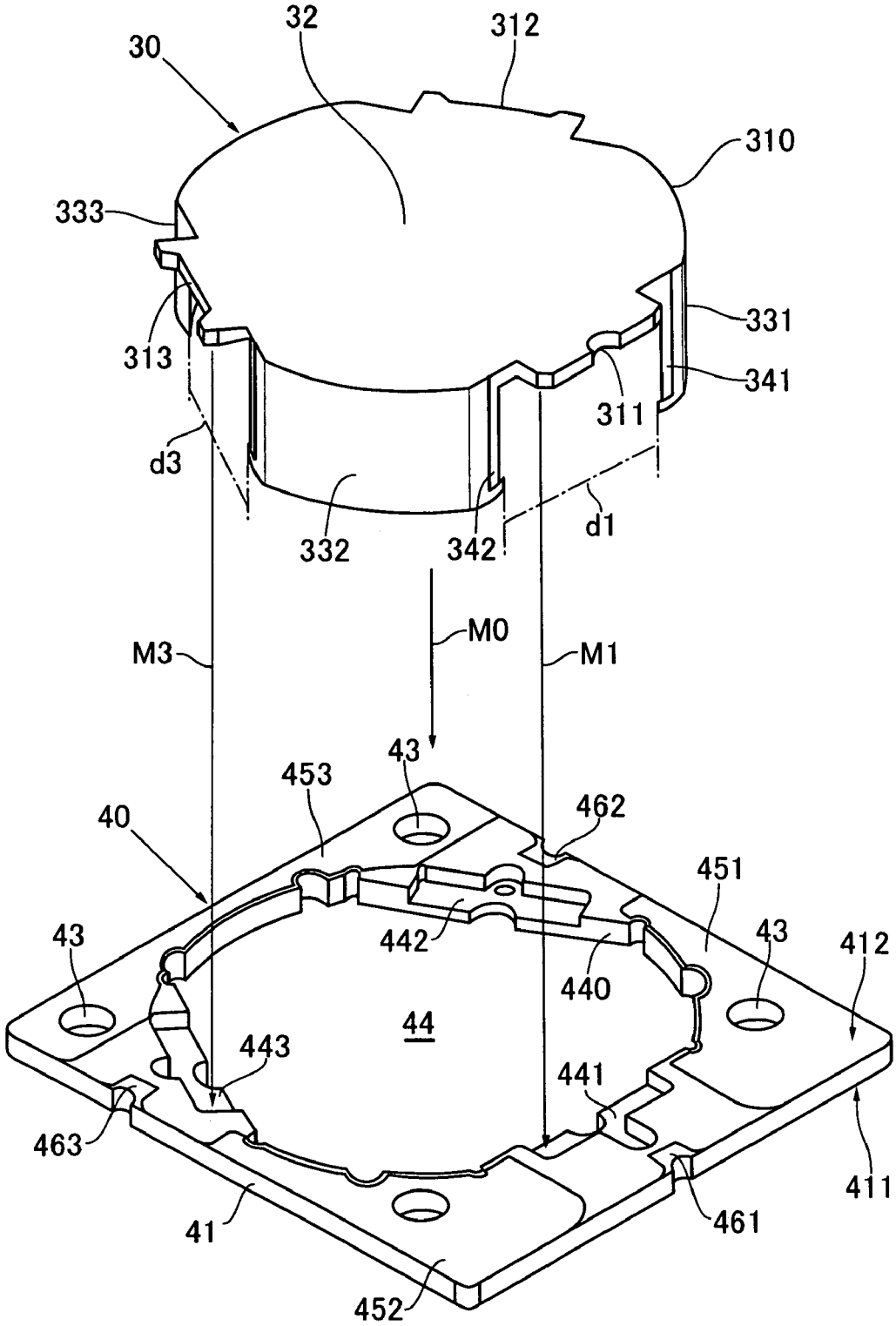
FIG. 4 is a perspective view showing an engaging configuration of a part of the disassembled configuration depicted in FIG. 3.
Figure 5:
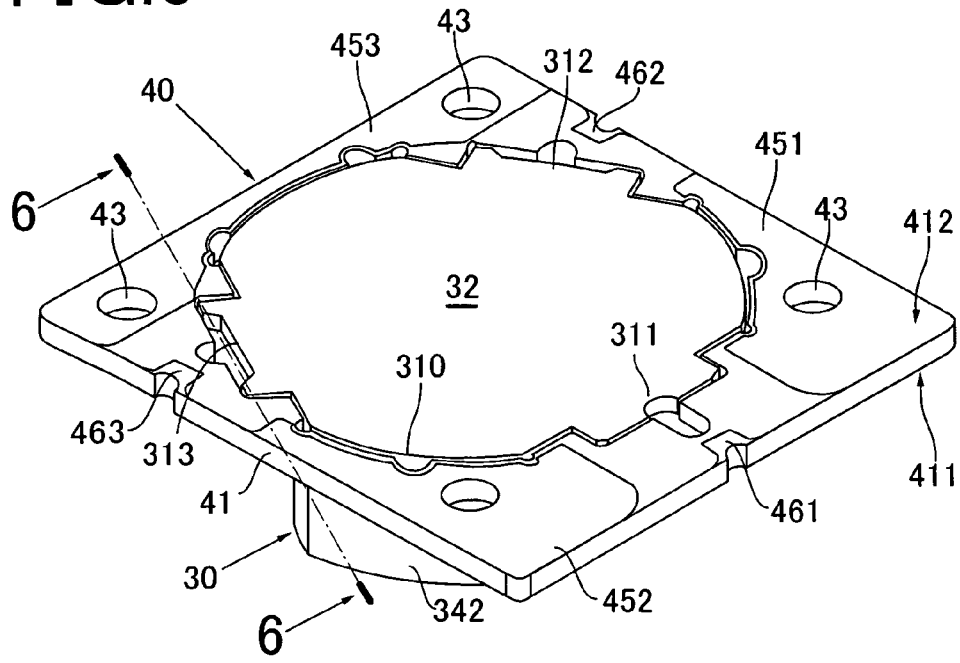
FIG. 5 is a perspective view showing an engagement completed state of the engagement depicted in FIG. 4.
Figure 6:
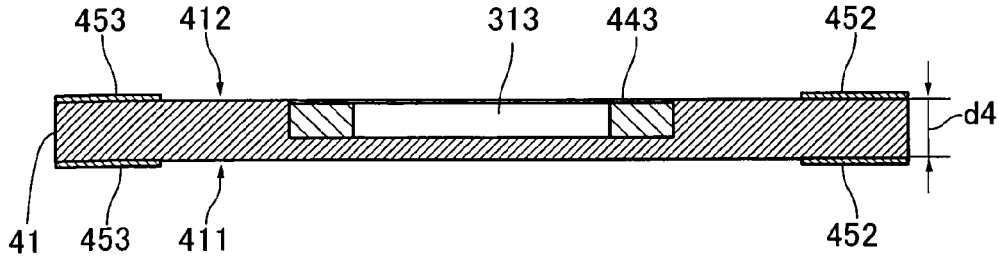
FIG. 6 is a cross-sectional view taken along a line 6-6 in FIG. 5.

The holder 30 is inserted into the holder insertion hole 44. This point will now be described in detail with reference to FIGS. 4 to 6. In FIGS. 4 to 6, like reference numerals denote parts corresponding to the constituent parts shown in the foregoing drawings.

Referring to FIG. 4, on the other surface 412 of the support member 40, the holder 30 is guided into the holder insertion hole 44 from the end portion of each of the first to third side wall portions 331 to 333 in a direction indicated by an arrow M0, and the first coupling protrusion piece 311 is guided in a direction indicated by an arrow M1 to be fitted in the first concave step portion 441, whilst the third coupling protrusion piece 313 is guided in a direction indicated by an arrow M3 to be fitted in the third concave step portion 443. Although not necessarily clear from the drawing, the second coupling protrusion piece 312 is also fitted in the second concave step portion 442.

Referring to FIGS. 5 and 6, on the other surface 412 of the support member 40, the first to third coupling protrusion pieces 311 to 313 of the holder 30 are respectively fitted in the first to third concave step portions 441 to 443 provided on the inner rim 440 of the holder insertion hole 44, and the bottom outer surface 32 of the holder 30 is lower than one surface 411 of the support member 40. Giving a more detailed description, the bottom outer surface 32 of the holder 30 is lower than one surface 411 of the support member 40, and constitutes the same plane as the other surface 412 of the support member 40. However, the bottom outer surface 32 may be higher than the other surface 412. In the embodiment according to the present invention, being lower than one surface 411 of the support member 40 means a direction from one surface 411 to the other surface 412. Likewise, being higher than the other surface 412 means a direction from the other surface 412 side to one surface 411 side.

After the holder 30 is inserted into the holder insertion hole 44 as shown in FIG. 5, the gyromagnetic component assembly 10 is accommodated in the inner space 300. A coupling relationship between the gyromagnetic component assembly 10, the holder 30 and the support member 40 will now be described again based on FIG. 2.

As shown in FIG. 2, when the gyromagnetic component assembly 10 is accommodated in the holder 30, a part of a circumference of each member constituting the gyromagnetic component assembly 10 protrudes toward the outside of the inner space 300 from each of the first to third intervals d1 to d3. Therefore, the support member 40 is held between the lower ferrite 16 protruding from the first to third intervals d1 to d3 and the first to third coupling protrusion pieces 331 to 333 fitted in the first to third concave step portions 441 to 443 in the gyromagnetic component assembly 10. In such a holding configuration, since a load is applied to the gyromagnetic component assembly 10 including the lower ferrite 16 by the lid member 35 as described above, the non-reciprocal circuit device can realize an excellent mechanical securing strength.

Additionally, the holder 30 has the first to third coupling protrusion pieces 311 to 313 protruding from the inner rim 310 of the bottom inner surface 31 in the radial direction in the first to third intervals d1 to d3. The holder insertion hole 44 has the first to third concave step portions 441 to 443 on the inner rim 440. Each of the first to third coupling protrusion pieces 311 to 313 is fitted in each of the first to third concave step portions 441 to 443. According to this configuration, it is possible to provide the non-reciprocal circuit device having a high mechanical securing strength in the fitting configuration of the holder 30 and the support member 40.

The support member 40 has the holder insertion hole 44 which is opened on at least one surface 411, and the bottom outer surface 32 of the holder 30 is inserted into this holder insertion hole 44. According to this configuration, it is possible to realize the non-reciprocal circuit device having a high mechanical securing strength.

Further, since the configuration in which the holder 30 is inserted into the holder insertion hole 44 is provided, a fitting configuration or the like can be adopted as an inserting conformation. Therefore, it is possible to provide the non-reciprocal circuit device having a reduction in the number of components, an improvement in the yield of assembly, and a reduction in the man-hour and cost for assembly.

Furthermore, a position of the bottom outer surface 32 of the holder 30 can be lowered by an amount corresponding to a depth of the holder insertion hole 44, which contributes to a reduction in height. Moreover, the height can be reduced without decreasing a capacity of the inner space 300 of the holder 30.

In the above-described fitting configuration of the holder 30 and the support member 40, the holder 30 has the inner space 300 with a bottom, and the gyromagnetic component assembly 10 is accommodated in this inner space 30. In this case, a position of the bottom outer surface 32 of the holder 30 is lowered by an amount corresponding to a depth of the holder insertion hole 44, and the height can be reduced without decreasing a capacity of the inner space 300 of the holder 30. Therefore, a reduction in height can be maintained even when the non-reciprocal circuit device is accommodated in the inner space 300.

The holder 30 includes the first to third coupling protrusion pieces 311 to 313, and the holder insertion hole 44 has the first to third concave step portions 441 to 443 on the hole edge thereof. The first to third coupling protrusion pieces 311 to 313 are fitted in the first to third concave step portions 441 to 443. According to this configuration, it is possible to provide the non-reciprocal circuit device having a higher mechanical securing strength of the holder 30 and the support member 40.

Additionally, according to the configuration in which the holder insertion hole 44 pieces from one surface 411 to the other surface 412 of the support member 40, the height of the non-reciprocal circuit device can be reduced by an amount corresponding to a thickness dimension d4 of the support member 44.

Utilizing one surface 411 and the other surface 412 of the support member 40 extending toward the outside of the holder insertion hole 44 can add a terminal, a monitor circuit, an isolator terminating resistor or the like, and realize development of a terminal configuration for surface mounting or a receptacle variation.

In the illustrated embodiment, the bottom outer surface 32 of the holder 30 has the substantially the same structural surface as the other surface 412 of the support member 40. According to this configuration, the bottom surface of the non-reciprocal circuit device can be entirely flattened. Therefore, plan processing is easy, and surface mounting can be stably carried out with respect to a print pattern or the like constituting a mobile communication device. However, the outer bottom surface 32 of the holder 30 does not necessary have to constitute the same plane as the other surface 412 of the support member 40, and a structure in which the outer bottom surface 32 is lower than one surface 411 of the support member 40 can suffice.

It is to be noted that the advantages of the present invention described with reference to FIGS. 1 to 6 can be likewise demonstrated in a lumped parameter type structure.

Figure 7:
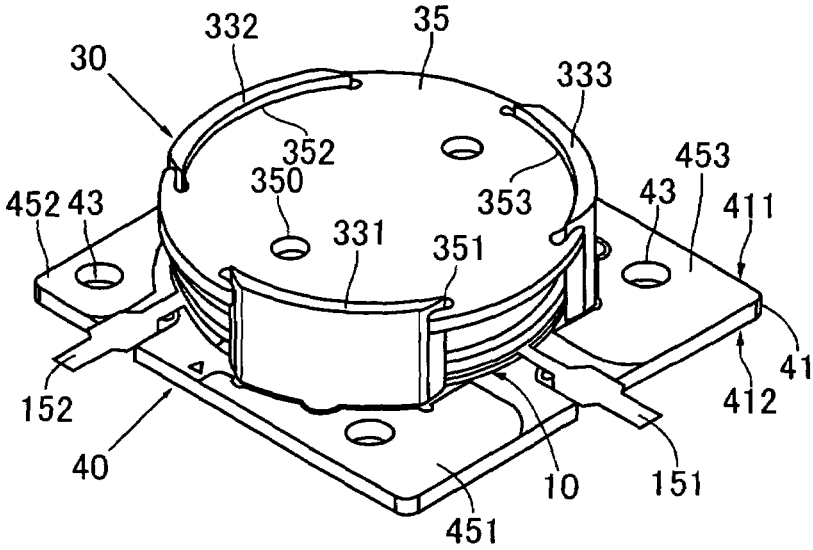
FIG. 7 is a perspective view showing a non-reciprocal circuit device according to another embodiment of the present invention.
Figure 8:
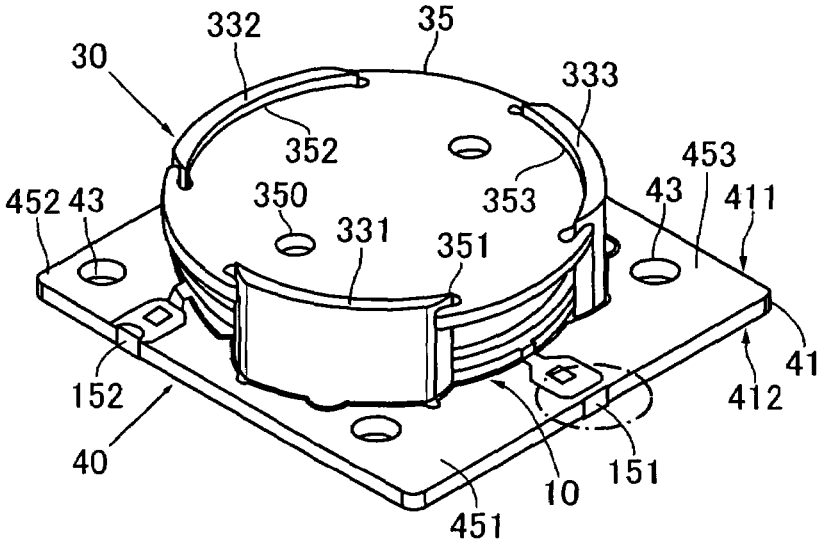
FIG. 8 is a perspective view showing a non-reciprocal circuit device according to still another embodiment of the present invention.
Figure 9:
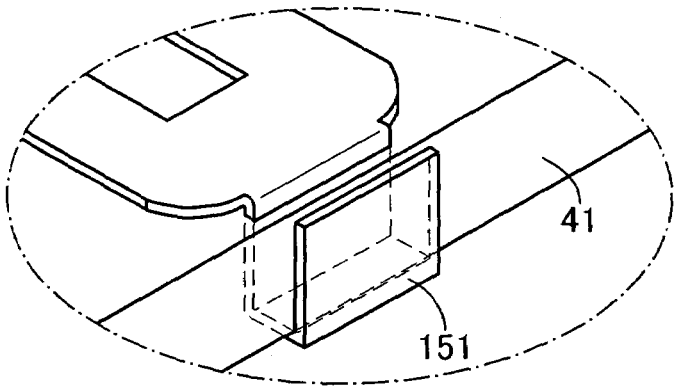
FIG. 9 is a perspective view showing a part of the non-reciprocal circuit device depicted in FIG. 8 in an enlarging manner.

In FIGS. 7 to 9, like reference numerals denote parts corresponding to the constituent parts illustrated in the foregoing drawings.

In the non-reciprocal circuit device shown in FIG. 7, terminals 151 to 153 are provided so as to protrude toward the outside of a support member 40. According to this configuration, an external connection conductor such as a microstrip line path can be connected to the terminals 151 to 153 by fixing screws to a circuit chassis via four through holes of the support member.

In the non-reciprocal circuit device depicted in FIG. 8, as shown in FIG. 9 in an enlarging manner, end portions of terminals 151 to 153 are led to the outer surface 412 of a support member 40 and then further led to one surface 411 of the same along side end surfaces. This configuration is suitable for surface mounting.

Figure 10:
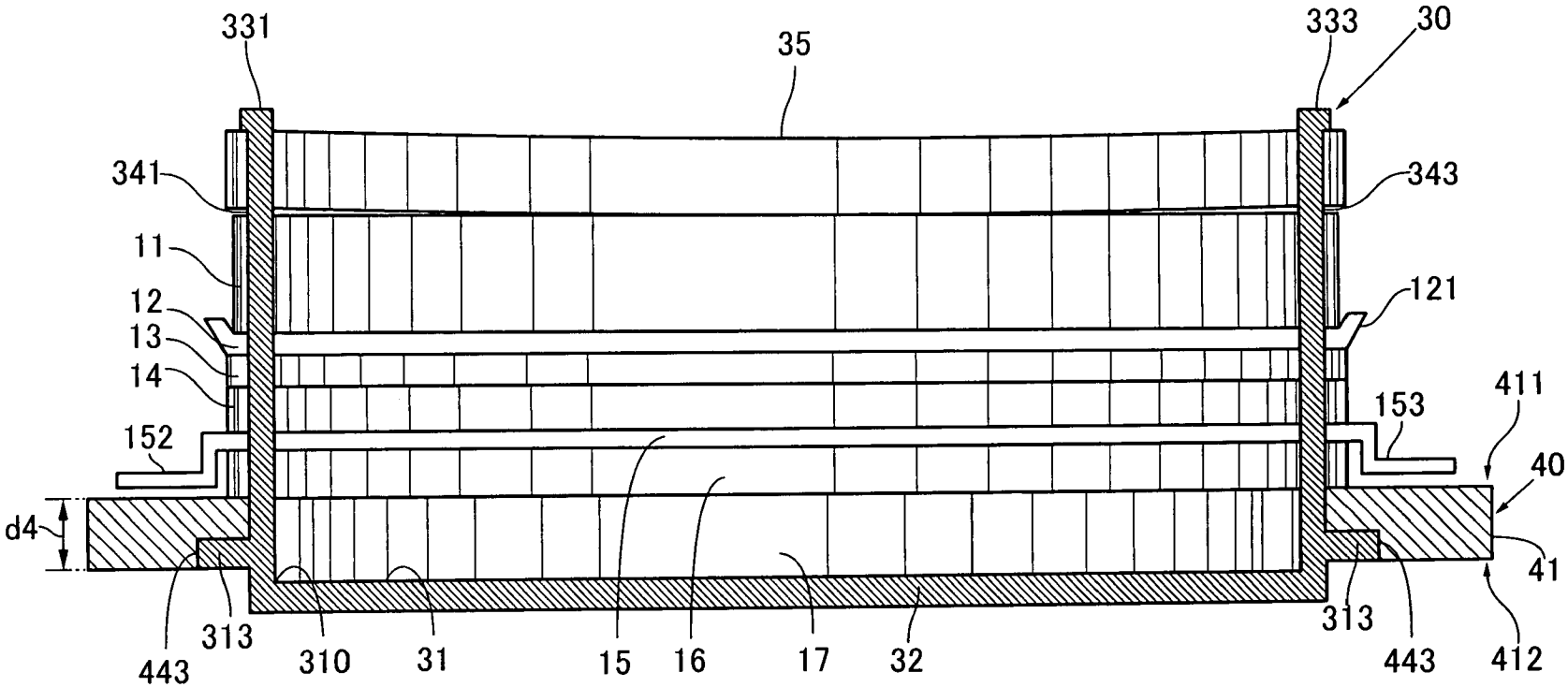
FIG. 10 is an end sectional view showing a non-reciprocal circuit device according to yet another embodiment of the present invention.
Figure 11:
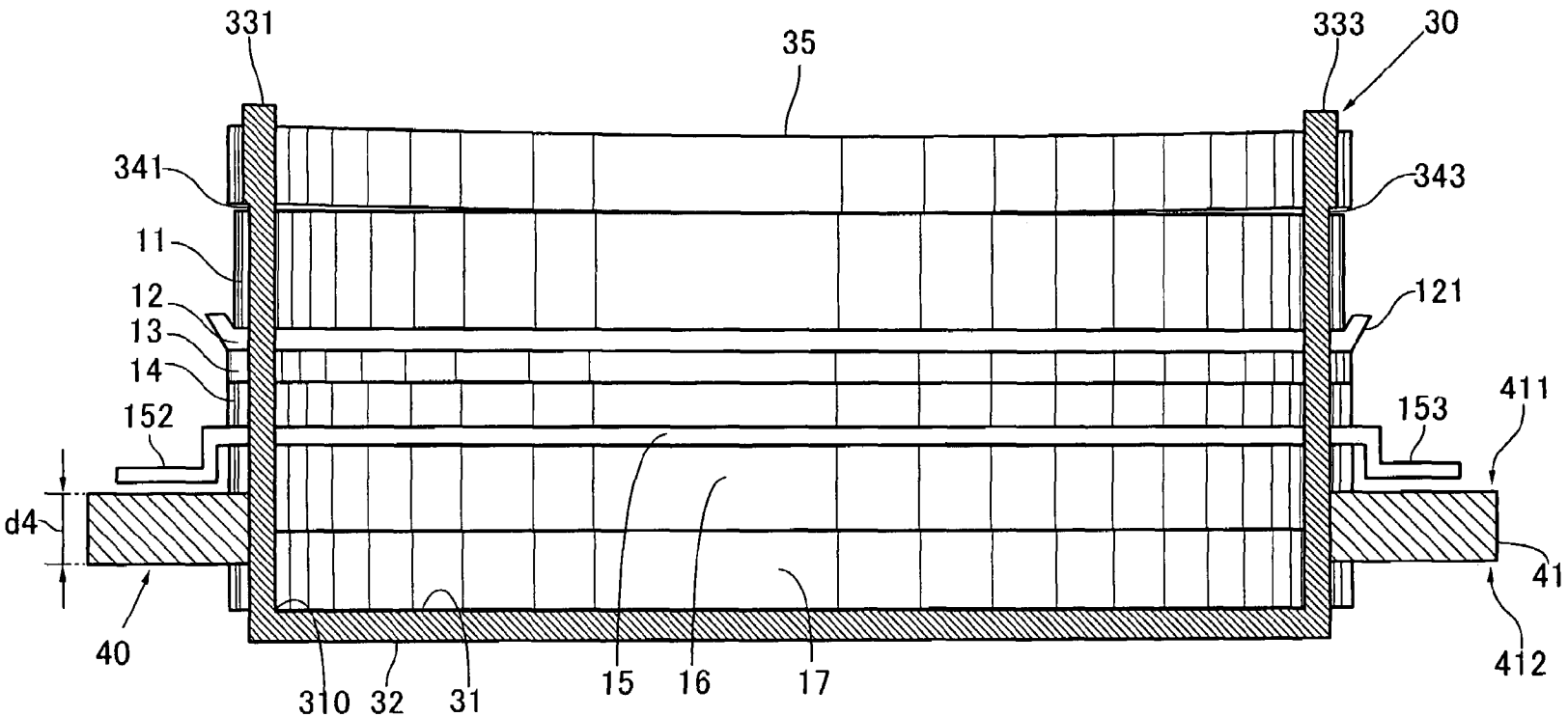
FIG. 11 is an end sectional view showing a non-reciprocal circuit device according to a further embodiment of the present invention.

In FIGS. 10 and 11, like reference numerals denote parts corresponding to the constituent parts illustrated in the foregoing drawings.

The non-reciprocal circuit device depicted in FIG. 10 shows an embodiment in which a bottom outer surface 32 protrudes from the other surface 412 and the bottom outer surface 32 and the other surface 412 do not form substantially the same planes. According to this configuration, the non-reciprocal circuit device can realize a further reduction in height.

Furthermore, the non-reciprocal circuit device depicted in FIG. 11 shows an embodiment in which a bottom outer surface 32 and the other surface 412 do not form substantially the same planes and in which a support member 40 is held between two members constituting an assembly 10. According to this configuration, the non-reciprocal circuit device can realize a further reduction in height, and it is possible to provide the non-reciprocal circuit device having a reduction in the number of components, an improvement in the yield of assembly, and a sufficiently reduction in the man-hour and cost for assembly.

Although the above has concretely described the contents of the present invention with reference to the preferred embodiments, it is self-apparent that a person skilled in the art can take various kinds of modifications based on basic technical concepts and teachings of the present invention.

What is claimed is:

1. A non-reciprocal circuit device comprising:

an assembly having a gyromagnetic component;

a holder; and a support member, wherein the assembly is accommodated in the holder, the support member has a holder insertion hole which is opened on at least one principal surface, the holder insertion hole has concave step portions on an inner hole rim, the holder includes a coupling protrusion piece, the coupling protrusion piece is provided on an outer bottom rim of the bottom surface, a bottom outer surface of the holder is inserted in the holder insertion hole, and the coupling protrusion piece is fitted in a concave step portion so that the holder is coupled with the support member.

2. The non-reciprocal circuit device according to claim 1, wherein the support member is held between a member constituting the assembly and the coupling protrusion piece.

3. The non-reciprocal circuit device according to claim 1, wherein the concave step portion is provided on the other principal surface side of the support member, and the holder is guided into the holder insertion hole from the other principal surface side.

4. The non-reciprocal circuit device according to claim 3, wherein the support member is held between a member constituting the assembly and the coupling protrusion piece.

5. The non-reciprocal circuit device according to claim 1, wherein the holder insertion hole pierces from the one principal surface to the other principal surface of the support member.

6. The non-reciprocal circuit device according to claim 5, wherein the concave step portion is provided on the other principal surface side of the support member, and the holder is guided into the holder insertion hole from the other principal surface side.

7. The non-reciprocal circuit device according to claim 6, wherein the support member is held between a member constituting the assembly and the coupling protrusion piece.

8. The non-reciprocal circuit device according to claim 1, wherein the bottom outer surface of the holder is lower than the one principal surface of the support member.

9. The non-reciprocal circuit device according to claim 8, wherein the holder insertion hole pierces from the one principal surface to the other principal surface of the support member.

10. The non-reciprocal circuit device according to claim 9, wherein the concave step portion is provided on the other principal surface side of the support member, and the holder is guided into the holder insertion hole from the other principal surface side.

11. The non-reciprocal circuit device according to claim 10, wherein the support member is held between a member constituting the assembly and the coupling protrusion piece.

12. The non-reciprocal circuit device according to claim 1, wherein the bottom outer surface of the holder and the other principal surface of the support member have structural surfaces which are substantially the same planes.

13. The non-reciprocal circuit device according to claim 12, wherein the holder insertion hole pierces from the one principal surface to the other principal surface of the support member.

14. The non-reciprocal circuit device according to claim 13, wherein the concave step portion is provided on the other principal surface side of the support member, and the holder is guided into the holder insertion hole from the other principal surface side.

15. The non-reciprocal circuit device according to claim 14, wherein the support member is held between a member constituting the assembly and the coupling protrusion piece.

16. The non-reciprocal circuit device according to claim 1, wherein the bottom outer surface of the holder is higher than the other principal surface of the support member.

17. The non-reciprocal circuit device according to claim 16, wherein the holder insertion hole pierces from the one principal surface to the other principal surface of the support member.

18. The non-reciprocal circuit device according to claim 17, wherein the concave step portion is provided on the other principal surface side of the support member, and the holder is guided into the holder insertion hole from the other principal surface side.

19. The non-reciprocal circuit device according to claim 18, wherein the support member is held between a member constituting the assembly and the coupling protrusion piece.

* * * * *